US010350556B2

(12) United States Patent
Xiong et al.

(10) Patent No.: US 10,350,556 B2
(45) Date of Patent: Jul. 16, 2019

(54) LOW HOLDUP VOLUME MIXING CHAMBER

(75) Inventors: Renqiang Xiong, Newton, MA (US); John Michael Bernard, Stoughton, MA (US)

(73) Assignee: MICROFLUIDICS INTERNATIONAL CORPORATION, Newton, MA (US)

( * ) Notice: Subject to any disclaimer, the term of this patent is extended or adjusted under 35 U.S.C. 154(b) by 2006 days.

(21) Appl. No.: 12/986,477

(22) Filed: Jan. 7, 2011

(65) Prior Publication Data

US 2012/0175442 A1 Jul. 12, 2012

(51) Int. Cl.
*B01F 13/00* (2006.01)
*B01F 5/02* (2006.01)

(52) U.S. Cl.
CPC ..... *B01F 5/0256* (2013.01); *B01F 13/0059* (2013.01); *Y10T 29/49826* (2015.01)

(58) Field of Classification Search
None
See application file for complete search history.

(56) References Cited

U.S. PATENT DOCUMENTS 4,533,254 A 8/1985 Cook et al.
4,634,134 A 1/1987 Entrikin
4,684,072 A 8/1987 Nelson et al.
4,746,069 A 5/1988 Entrikin et al.
4,908,154 A 3/1990 Cook et al.
5,314,506 A 5/1994 Midler, Jr. et al.
5,417,956 A 5/1995 Moser
5,466,646 A 11/1995 Moser
5,533,254 A 7/1996 Gallo et al.
(Continued)

FOREIGN PATENT DOCUMENTS

EP 1036588 9/2000
JP S57-89935 6/1982
(Continued)

OTHER PUBLICATIONS

Schilling, E. Basic Microfluidic Concepts. Washington Edu. Sep. 7, 2001.*
(Continued)

*Primary Examiner* — Kara M Peo
(74) *Attorney, Agent, or Firm* — K&L Gates LLP

(57) ABSTRACT

A compact interaction chamber is used to cause high shear, impact forces, and cavitation to reduce particle size and mix fluids while reducing waste and holdup volume. A first housing made of stainless steel holds an inlet mixing chamber element and an outlet mixing chamber element in a female bore using thermal expansion. The inlet and outlet mixing chamber elements are manufactured so that the diameter of the cooled female bore is slightly smaller than the diameter of the mixing chamber elements. The first housing is heated, expanding the diameter of the female bore enough to allow the inlet and outlet mixing chamber elements to be inserted. After the mixing chamber elements are inserted and aligned within the female bore, the first housing is allowed to cool. Once cooled, the female bore contracts and applies sufficient hoop stress to securely hold the mixing chamber elements during high shear force mixing.

21 Claims, 5 Drawing Sheets

(56) References Cited

U.S. PATENT DOCUMENTS

| | | | | |
|---|---|---|---|---|
| 5,570,955 | A | 11/1996 | Swartwout et al. | |
| 5,578,279 | A | 11/1996 | Dauer et al. | |
| 5,615,949 | A | 4/1997 | Morano et al. | |
| 5,620,147 | A | 4/1997 | Newton | |
| 5,664,938 | A * | 9/1997 | Yang | 417/313 |
| 5,984,519 | A * | 11/1999 | Onodera et al. | 366/340 |
| 6,159,442 | A | 12/2000 | Thumm et al. | |
| 6,221,332 | B1 | 4/2001 | Thumm et al. | |
| 6,558,435 | B2 | 5/2003 | Am Ende et al. | |
| 6,607,784 | B2 | 8/2003 | Kipp et al. | |
| 6,869,617 | B2 | 3/2005 | Kipp et al. | |
| 6,932,914 | B2 | 8/2005 | LeClair | |
| 6,960,307 | B2 | 11/2005 | LeClair | |
| 6,977,085 | B2 | 12/2005 | Werling et al. | |
| 7,297,288 | B1 | 11/2007 | LeClair | |
| 7,326,054 | B2 | 2/2008 | Todd et al. | |
| 2002/0071870 | A1 | 6/2002 | Sharma | |
| 2002/0196701 | A1 * | 12/2002 | Mastbrook | 366/142 |
| 2003/0206959 | A9 | 11/2003 | Kipp et al. | |
| 2004/0266890 | A1 | 12/2004 | Kipp et al. | |
| 2005/0089993 | A1 * | 4/2005 | Boccazzi | B01F 13/0059 435/286.2 |
| 2005/0191359 | A1 | 9/2005 | Goldshtein et al. | |
| 2006/0151899 | A1 | 7/2006 | Kato et al. | |
| 2007/0291581 | A1 * | 12/2007 | Ehrfeld et al. | 366/153.2 |
| 2008/0038333 | A1 | 2/2008 | Magadassi et al. | |
| 2009/0269250 | A1 * | 10/2009 | Panagiotou et al. | 422/129 |
| 2009/0297565 | A1 | 12/2009 | Muller et al. | |
| 2010/0012111 | A1 | 1/2010 | Greenwood et al. | |

FOREIGN PATENT DOCUMENTS

| | | |
|---|---|---|
| JP | H05-170852 | 7/1993 |
| JP | H8-117578 | 5/1996 |
| JP | H08-117585 | 5/1996 |
| JP | H9-169026 | 6/1997 |
| JP | H10-118474 | 5/1998 |
| JP | 10-192671 | 7/1998 |
| JP | H10-180065 | 7/1998 |
| JP | H10-180066 | 7/1998 |
| JP | H10-180068 | 7/1998 |
| JP | 2000-254469 | 9/2000 |
| JP | 2003-164745 | 6/2003 |
| JP | 2003-311136 | 11/2003 |
| JP | 2005-083212 | 3/2005 |
| JP | 2005-144329 | 6/2005 |
| JP | 2006-021471 | 1/2006 |
| JP | 2006-326449 | 12/2006 |
| JP | 2006-341146 | 12/2006 |
| JP | 2008-037842 | 2/2008 |
| JP | 2008-081772 | 4/2008 |
| JP | 2008-284514 | 11/2008 |
| JP | 2009-131831 | 6/2009 |
| KR | 100761033 | 10/2007 |
| WO | 1999/007466 | 2/1999 |
| WO | 2005/018687 | 3/2005 |
| WO | WO2006132443 | 12/2006 |
| WO | 2007/051520 | 5/2007 |
| WO | 2007/148237 | 12/2007 |

OTHER PUBLICATIONS

"Microchannel." Wikipedia. May 8, 2012.*

International Search Report and Written Opinion dated May 3, 2012 issued for International PCT Application No. PCT/US2012/020456.

Gruverman, Breakthrough Ultraturbulent Reaction Technology Opens Frontier for Developing Life-Saving Nanometer-Scale Suspensions & Dispersions, Ultraturbulent Reaction Technology publication, Jan./Feb. 2003, vol. 3, No. 1 (4 pages).

Gruverman, A Drug Delivery Breakthrough—Nanosuspension Formulations for Intravenous, Oral & Transdermal Administration of Active Pharmaceutical Ingredients, Nanosuspension Formulations publication, Sep. 2004, vol. 4, No. 7, pp. 58-59.

Gruverman, Nanosuspension Preparation and Formulation, Nanosuspension Formulation publication, Sep. 2005, vol. 5, No. 8, pp. 1-4.

Gruverman, Optimizing Drug Delivery—Formulation Development and Scaleable Manufacturing Methodology, Nanoemulsions and Nanosuspensions Prepared by Ultrahigh-Shear Fluid Processing, Presentation at Particles 2006, May 14, 2006.

Gruverman, Advances in Continuous Chemical Reactor Technology, Oct. 30, 2006, retrieved online Jun. 2, 2009, URlhttp://aimediaserver4com/chemeng/pdf/feature-oct06.pdf, Figure V, p. 5.

PCT International Search Report dated Jun. 15, 2009 (PCT/US2009/041511).

Johnson, et al., Chemical Processing and Micromixing in Confined Impinging Jets, AlChE Journal, vol. 49, No. 9, Sep. 2003, pp. 2264-2282.

U.S. Appl. No. 13/085,903, filed Apr. 13, 2011, Renqiang, X., Bernard, J.

U.S. Appl. No. 13/085,939, filed Apr. 13, 2011, Renqiang, A., Bernard, J.

English Translation of Office action dated Jun. 26, 2018 for Korean Patent Application No. 10-2013-7020790.

* cited by examiner

LOW HOLDUP VOLUME MIXING CHAMBER

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND OF THE INVENTION

For certain pharmaceutical applications, manufacturers need to process and mix expensive liquid drugs for testing and production using the lowest possible volume of fluid to save money. Current mixing devices operate by pumping the fluid to be mixed under high pressure through an assembly that includes two mixing chamber elements secured within a housing. The fluid mixes between the two mixing chamber elements under high pressure, resulting in high energy dissipation. The two mixing chamber elements must be held secure enough to withstand the high pressures and energy resulting from this mixing. In current mixing chambers, the two mixing chamber elements are secured with a tube held under high tension such that the tube stretches slightly, and the necking down effect holds the mixing chamber elements secure. To hold the mixing chamber elements in this way, the tube must be relatively long, and current devices are large and require many component parts. The relatively large and complex construction of current mixing devices also implies a large holdup volume of the fluid being mixed, which results in excess waste of expensive mixing product.

DETAILED DESCRIPTION

The present disclosure is generally directed to a compact interaction chamber that secures mixing chamber elements using internal forces of the components of the assembly rather than applied torque to put the assembly in tension and cause a necking down effect. The compact interaction chamber results in the requirement of fewer components and a smaller size. By decreasing the size and complexity of compact interaction chamber, the flow paths are also shortened, thereby decreasing the holdup volume and saving the manufacturer using the system valuable resources without sacrificing quality and consistency of the mixing.

Specifically, the compact interaction chamber of the present disclosure includes, among other components: a first housing; a second housing; an inlet retaining member; an outlet retaining member; an inlet mixing chamber element; and an outlet mixing chamber element. When assembled, the inlet retaining member and the outlet retaining member are situated facing one another within a first opening of the first housing. The inlet and outlet mixing chamber elements reside adjacent one another and between the inlet and outlet retaining members within the first opening. The second housing is fastened to the first housing such that a male protrusion on the second housing is inserted into the first opening making contact with the second retaining member. When the first and second housings are fastened together, the first retaining member and second retaining member are forced toward one another, thereby compressing the inlet and outlet retaining members and properly aligning the inlet and outlet mixing chamber elements together. The mixing chamber elements are further secured for high pressure mixing by the hoop stress exerted on the inlet and outlet mixing chamber elements by the inner wall of the first opening, as will be explained in further detail below.

Figure 1:
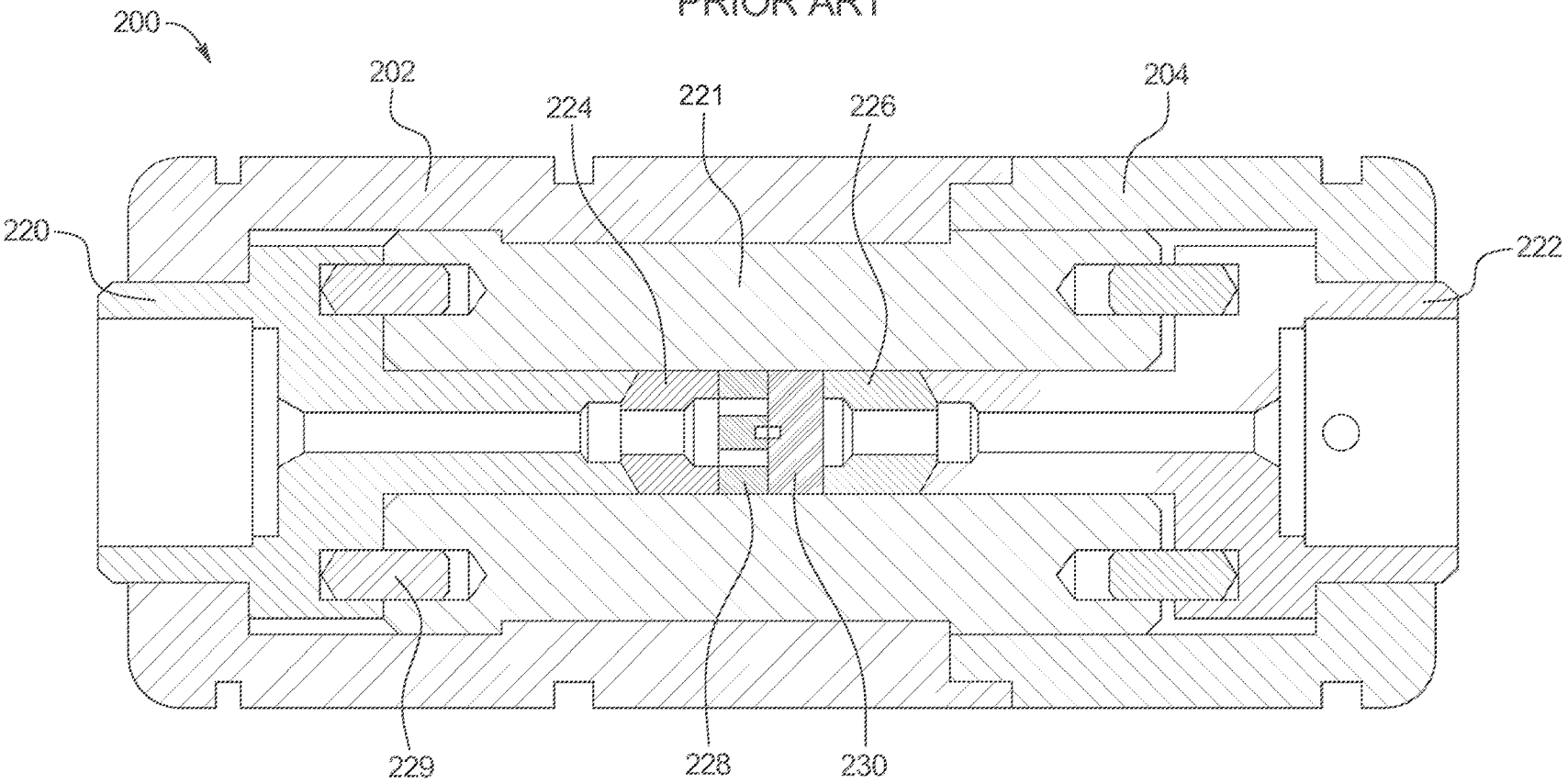
FIG. 1 PRIOR ART
FIG. 1 is a cross-sectional view of a prior art mixing device.

Referring now to FIG. 1, a prior art mixing assembly is illustrated. The mixing assembly 200 includes an inlet cap 202 and an outlet cap 204. The inlet cap 202 includes threads that are configured to engage complimentary threads on the outlet cap 204. The mixing assembly 200 also includes an inlet flow coupler 220, an outlet flow coupler 222, an aligning tube 221, an inlet retainer 224, an outlet retainer 226, an inlet mixing chamber element 228 and an outlet mixing chamber element 230.

The inlet flow coupler 220 is arranged within the inlet cap 202, and the outlet flow coupler 222 is arranged within the outlet flow cap 204. When assembled, the tube 221 stays aligned with both the inlet flow coupler 220 and the outlet flow coupler 222 with the use of a plurality of pins 229. The inlet retainer 224 and the outlet retainer 226 are arranged within the tube 221, and serve to align and retain the inlet mixing chamber element 228 and the outlet mixing chamber element 230. The inlet and outlet retainers 224 and 226 make contact with the inlet flow coupler 220 and the outlet flow coupler 222 respectively.

When the device is fully assembled, a flow path is formed between the inlet flow coupler 220, the inlet retainer 224, the inlet mixing chamber element 228, the outlet mixing chamber element 230, the outlet retainer 226 and the outlet flow coupler 222. The unmixed fluid enters the inlet flow coupler 220 and travels through the inlet retainer 224 and to the inlet mixing chamber element 228. Under high pressure and as a result of the high energy reaction, the unmixed fluid is mixed between the inlet mixing chamber element 228 and the outlet mixing chamber element 230. The mixed fluid then travels through the outlet retainer 226 and the outlet flow coupler 222.

To ensure that the mixing chamber elements are held with sufficient security to withstand the high pressure and high energy of the mixing, the inlet cap 202 threadingly engages the outlet cap 204. As torque is increased on the inlet cap 202 and outlet cap 204, the inlet flow coupler 220 and outlet flow coupler 222 are forced toward one another, and the tube 221 is put under tension. As the tension increases, the tube stretches slightly, undergoing a necking down effect, and thereby reducing in diameter. The fluid being mixed between the inlet mixing chamber element 228 and the outlet mixing chamber element 230 is under very high pressure, and therefore the inlet cap 202 and outlet cap 204 must be capable of imparting high amounts of force on the flow couplers, retainers and mixing chamber elements. Additionally, the inlet cap 202 and the outlet cap 204 must be capable of forcing the tube 221 to stretch and thereby slightly decrease in diameter to clamp down radially on the inlet mixing chamber element 228 and the outlet mixing chamber element 230. As the force increases, the inlet flow coupler 220 pushes on the inlet retainer 224 and the outlet flow coupler 222 pushes on the outlet retainer 226, which in turn sealingly compresses the inlet mixing chamber element 228 and the outlet mixing chamber element 230. To achieve the levels of torque required to ensure a fluid tight seal at high pressure, and to stretch the tube 221 with sufficient tensile force to hold the inlet mixing chamber element 228 and the outlet mixing chamber element 230, the tube must be relatively long, and therefore flow couplers, the inlet cap and outlet cap must accordingly be large enough to accommodate the longer tube. As a result of the longer tube, and larger flow couplers and caps, the flow path from the inlet flow coupler to the outlet flow coupler is longer than necessary, and therefore the holdup volume and amount of wasted fluid is higher than in smaller devices that provide comparable mixing results.

As discussed below, in the compact interaction chamber of the present disclosure, the mixing chamber elements are secured using both compression from the torque of fastening two housings together as well as hoop stress of the inner walls of the first housing directed radially inwardly on the mixing chamber elements. However, rather than using a tube member that would need to be stretched to hold the mixing chamber elements radially, the first housing is heated prior to insertion of the mixing chamber elements, and allowed to cool and contract once the mixing chamber elements are inserted and aligned. By securing the mixing chamber elements with the hoop stress of the first housing applied as a result of thermal expansion and contraction, the torque required to compress the mixing chamber elements together is significantly reduced. Therefore, the compact interaction chamber can be reduced in size, number of components, and complexity that results in a significant reduction in holdup volume.

Figure 2:
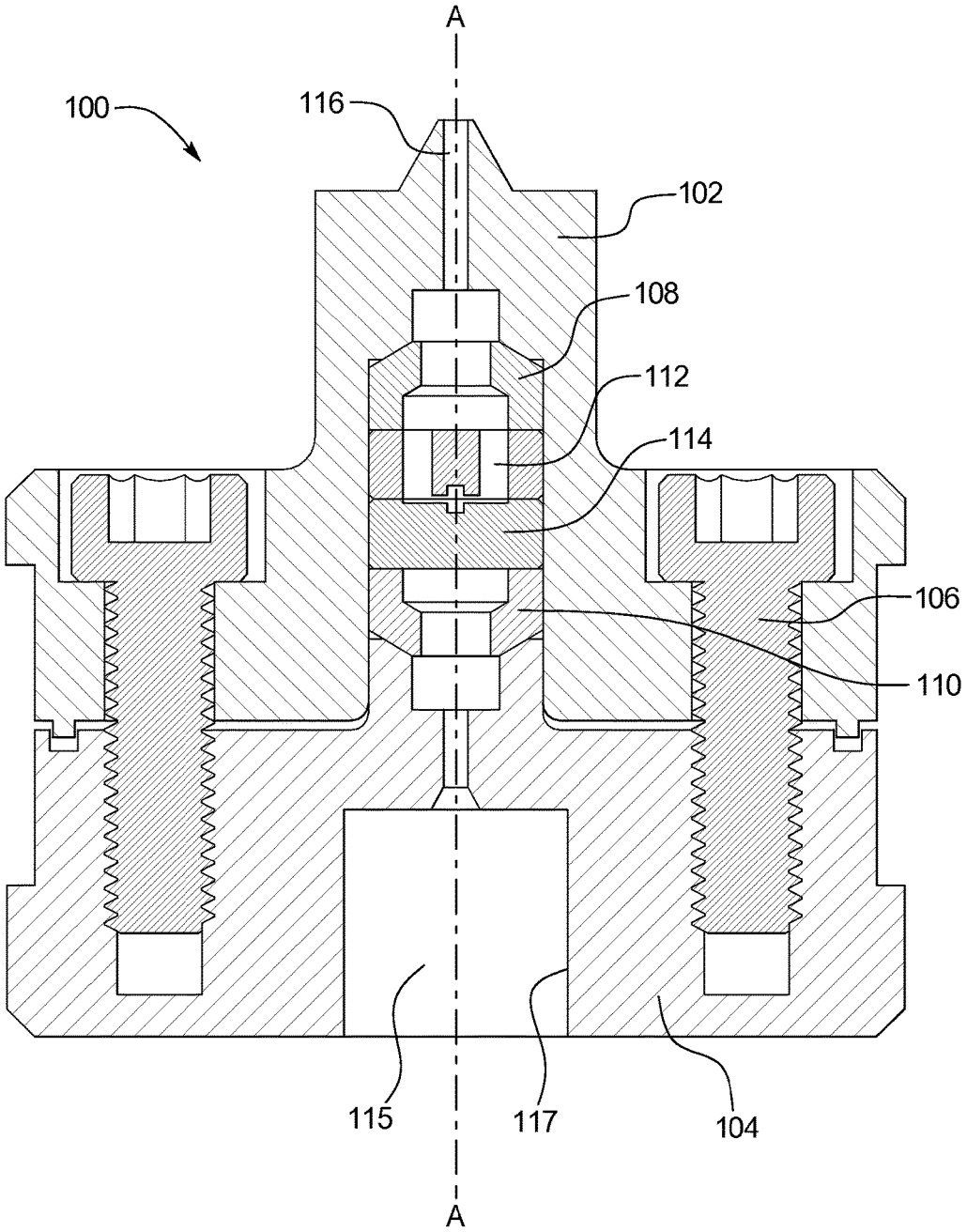
FIG. 2 is a cross-sectional view of an example assembled compact interaction chamber taken along line X-X of FIG. 3, according to one example embodiment of the present invention.
Figure 3:
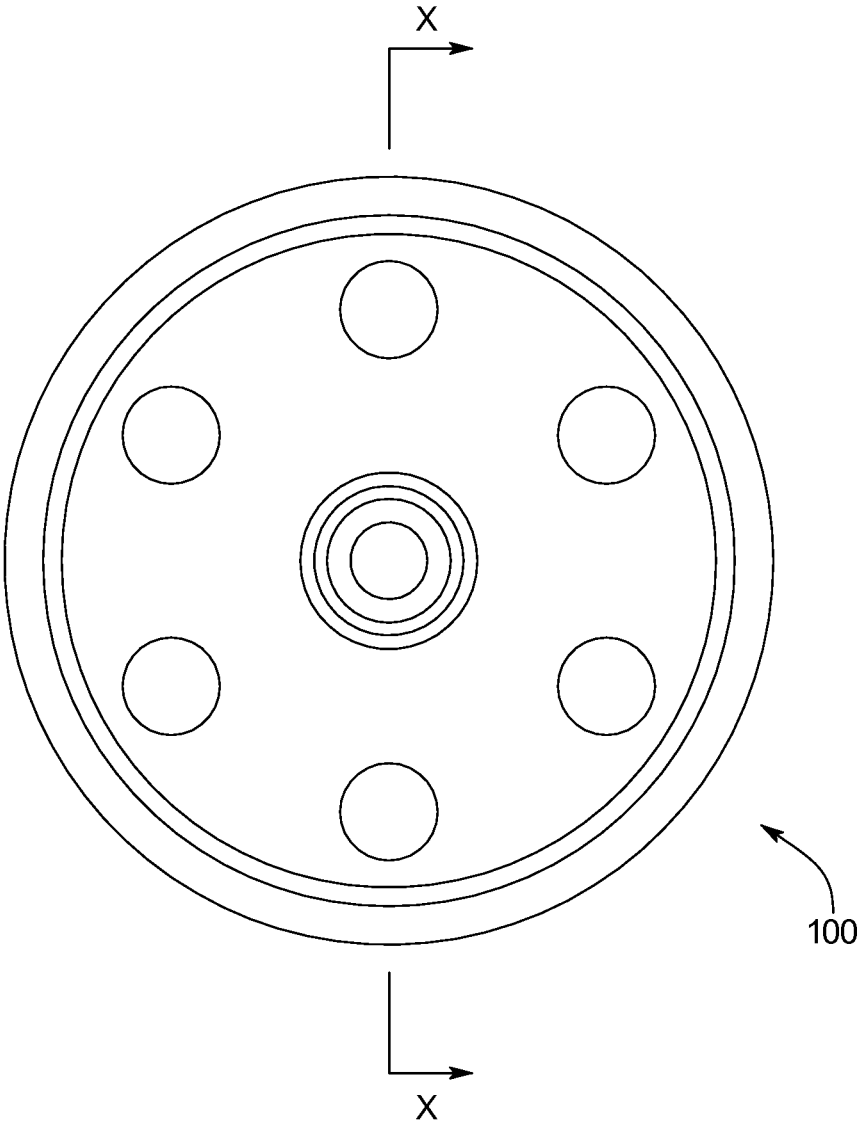
FIG. 3 is a top view of the assembled example compact interaction chamber according to one example embodiment of the present invention.
Figure 4:
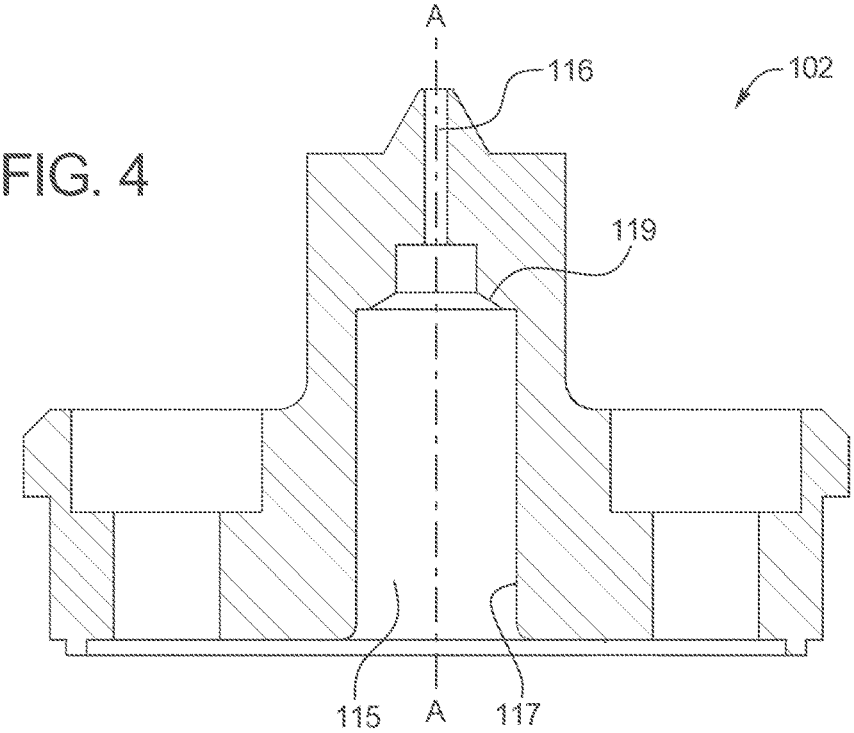
FIG. 4 is a cross-sectional view of the first housing of the example compact interaction chamber taken along line X-X of FIG. 3 according to one example embodiment of the present invention.
Figure 5:
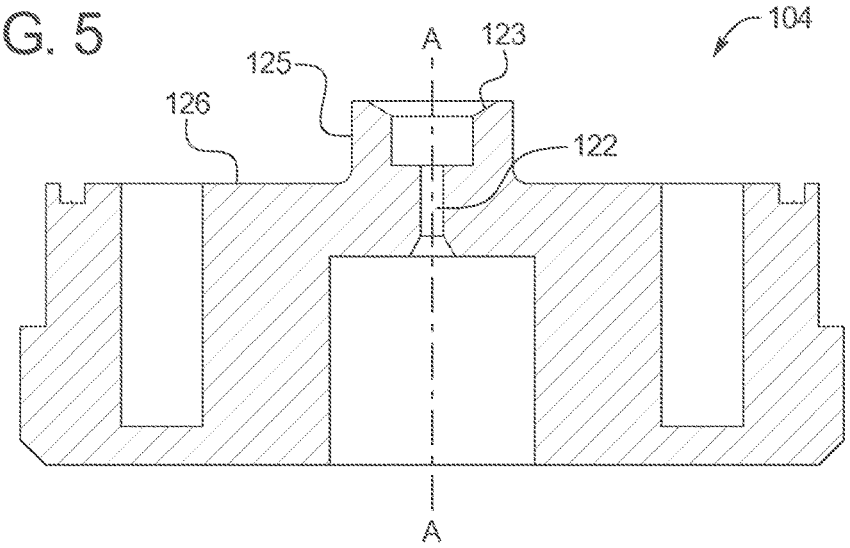
FIG. 5 is a cross-sectional view of the second housing of the example compact interaction chamber taken along line X-X of FIG. 3 according to one example embodiment of the present invention.
Figure 6:
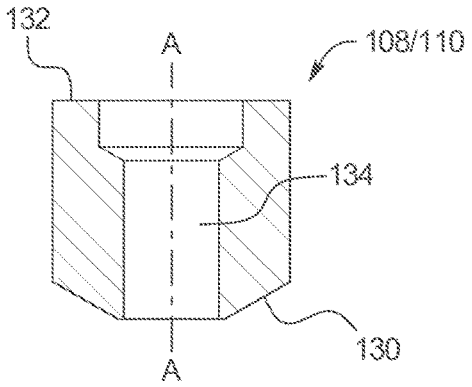
FIG. 6 is a cross-sectional view of the retaining element of the example compact interaction chamber taken along line X-X of FIG. 3 according to one example embodiment of the present invention.
Figure 7:
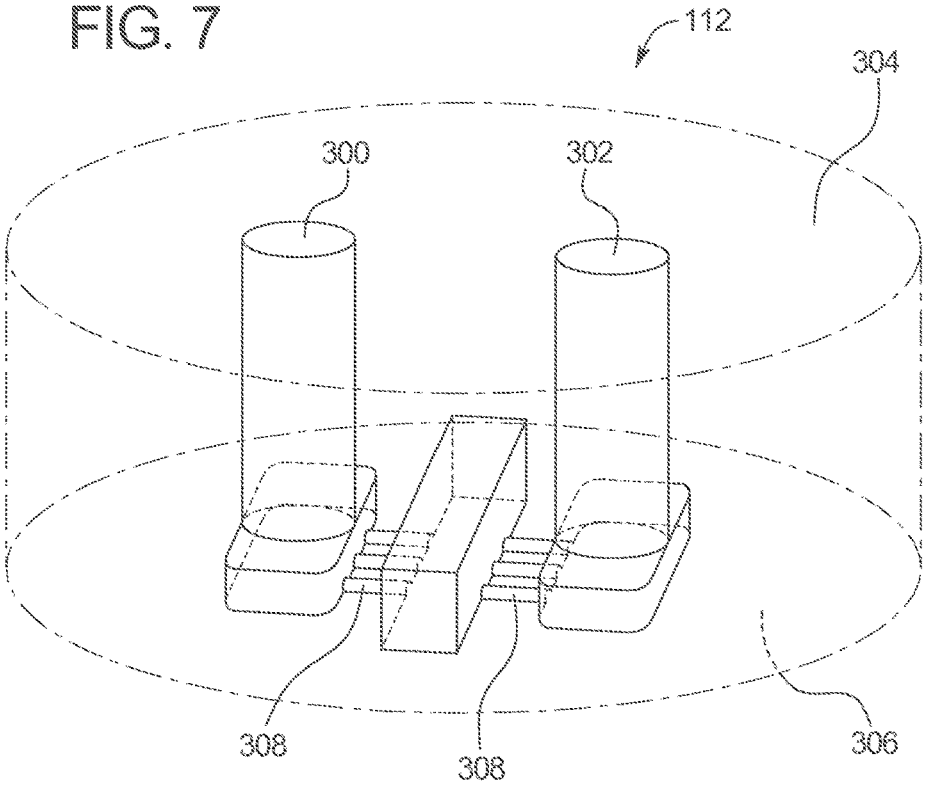
FIG. 7 is a perspective cross-sectional view of the inlet mixing chamber element of the example compact interaction chamber according to one example embodiment of the present invention.
Figure 8:
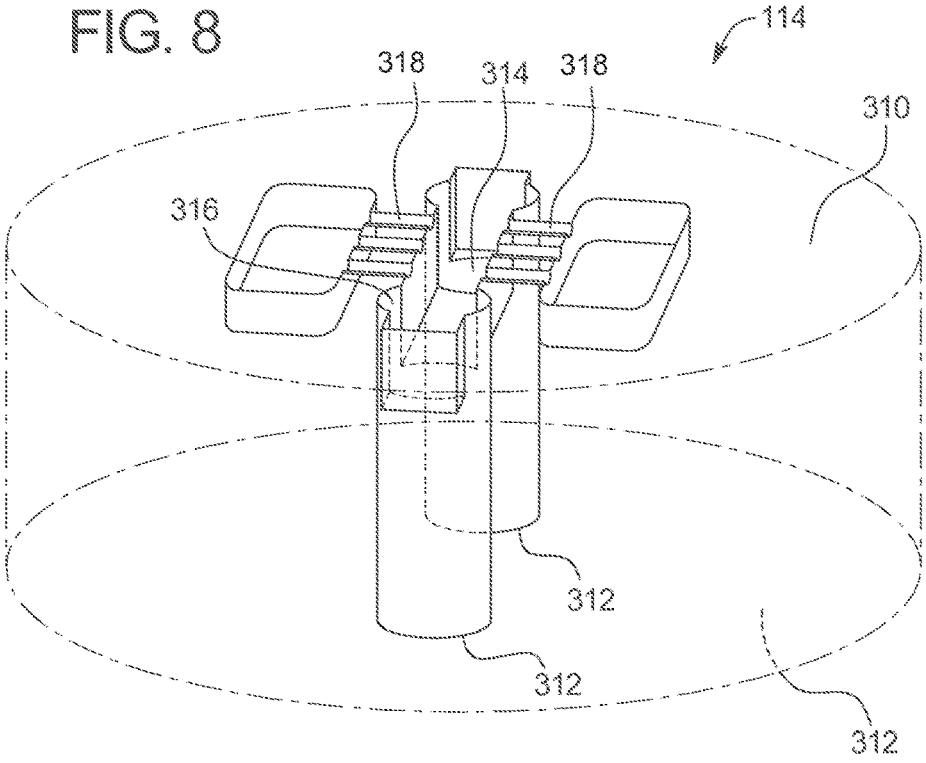
FIG. 8 is a perspective cross-sectional view of the outlet mixing chamber element of the example compact interaction chamber according to one example embodiment of the present invention.

Referring now to FIGS. 2 to 8, one example embodiment of the compact interaction chamber is illustrated. FIG. 2 illustrates a cross-sectional view of the assembled interaction chamber assembly 100 taken along the line X-X of the top view shown in FIG. 3. FIG. 4 illustrates the first housing 102 in detail, FIG. 5 illustrates the second housing 104 in detail and FIG. 6 illustrates the inlet/outlet retainer 108/110 in detail. FIG. 7 illustrates the inlet mixing chamber element 112 in detail and FIG. 8 illustrates the outlet mixing chamber element 114 in detail.

As seen in FIG. 2, the assembled compact interaction chamber 100 may include a generally cylindrically shaped first housing 102 and a generally cylindrically shaped second housing 104. The first housing 102 is configured to be operably fastened to the second housing 104 using any sufficient fastening technology. In the illustrated example embodiment, the first housing 102 is fastened to the second housing 104 with a plurality of bolts 106 arranged in a circular array around a central axis A. It should be appreciated that the generally cylindrically shaped first housing 102 and the generally cylindrically shaped second housing 104 share central axis A when assembled.

Between the first housing 102 and the second housing 104 resides an inlet retainer 108, an outlet retainer 110, an inlet mixing chamber element 112 and outlet mixing chamber element 114. The inlet retainer 108 is arranged adjacent to the inlet mixing chamber element 112. The inlet mixing chamber element 112 is arranged adjacent to the outlet mixing chamber element 114, which is arranged adjacent to the outlet retainer 110. When the compact interaction chamber 100 is assembled, bolts 106 clamp the first housing 102 to the second housing 104, thereby compressing the inlet mixing chamber element 112 and outlet mixing chamber element 114 between the inlet retainer 108 and the outlet retainer 110.

After assembly, an unmixed fluid flow is directed into inlet 116 of the first housing 102, and through an opening in inlet retainer 108. As discussed in more detail below, the unmixed fluid flow is then directed though a plurality of small pathways in the inlet mixing chamber element 102 in the direction of the fluid path. The fluid then flows in a direction parallel to the face of the inlet mixing chamber element 112 and the face of the adjacent outlet mixing chamber element 114 through a plurality of micro channels formed between the inlet mixing chamber element 102 and the outlet mixing chamber element 104. The fluid is mixed when the plurality of micro channels converge. The mixed fluid is directed through a plurality of small pathways in the outlet mixing chamber element 104, through an opening 120 in outlet retainer 110, and through outlet 122 of the second housing 104.

It should be appreciated that the plurality of bolts 106 used to fasten the first housing 102 to the second housing 104 provide a clamping force sufficient to compress the inlet mixing chamber element 112 and the outlet mixing chamber element 114 so that the microchannels formed between the two faces are fluid tight. However, due to the high pressure and the high energy dissipation resulting from the mixing taking place between the inlet mixing chamber element 112 and the outlet mixing chamber element 114, the compression force applied by the torqued bolts 106 alone may not be sufficient to hold the mixing chamber elements static within the first opening of the first housing 102 during mixing. Thus, in addition to the compressive force applied by the bolts 106, the mixing chamber elements 112, 114 are held circumferentially by the inner wall 117 of the first opening 115 of the first housing 102, which applies a large amount of hoop stress directed radially inwardly on the mixing chamber elements, as will be further discussed below. This secondary point of retention and security reduces the required amount of compressive force to hold the mixing chamber elements in place during high pressure and high energy mixing.

For example, due to the hoop stress applied to the mixing chamber elements, each of six bolts 106 in one embodiment need only a torque force of 100 inch-pounds to hold the mixing chamber elements together to create a seal. Prior art devices that use primarily compression to secure the mixing chamber elements as discussed above, however, tend to require significantly higher amounts of torque force to hold the mixing chamber elements together to create a seal (about 130 foot-pounds of torque). Because the prior art devices use a tube member that must be stretched to decrease its diameter and clamp down on the mixing chamber elements, the prior art devices require larger housings, more components and therefore, a higher hold-up volume of approximately 0.5 ml. In one embodiment of the present disclosure, the mixing chamber elements are secured within the first opening of the first housing and achieve the high hoop stress imparted from the inner wall of the first housing onto the outer circumference of the mixing chamber elements, the present disclosure takes advantage of precision fit components and the properties of thermal expansion. The hold-up volume of the compact interaction chamber of the present disclosure is around 0.05 ml.

An example procedure for assembling one embodiment of the compact interaction chamber of the present disclosure are now described with reference to the assembled compact interaction chamber in FIG. 2 and each individual component illustrated in FIGS. 4 to 8.

First, the inlet retaining member 108, as shown in FIG. 6, may be inserted into the first opening of the first housing, as shown in FIG. 4. The inlet retaining member 108 has a substantially cylindrical shape, and fits concentrically within the first opening of the first housing. When inserted, the inlet retaining member 108 includes a chamfered surface 130 that is configured contact a complimentary chamfered interior surface 119 of the first housing 102. This chamfered mating between the first housing 102 and the inlet retaining member 108 ensures that the inlet retaining member 108 self-centers within the first opening and lines up properly and squarely to the inner wall 117 of the first opening 115. It should be appreciated that the inlet retaining member 108 includes a concentric passageway 132 which allows fluid to flow through the inlet retaining member 108. The passageway 132 lines up with flow path 116 of the first housing 102, through which the unmixed fluid is pumped from a separate component in the mixing system.

Second, the first housing 102 may be heated to at least a predetermined temperature, at which point the first opening 115 expands from a first opening diameter to at least a first opening expanded diameter. In some example embodiments, the first housing is made of stainless steel, and the first housing is heated using a hot plate or any other suitable method of heating stainless steel. In one such embodiment, the predetermined temperature at which the first housing is heated is between 100° C. and 130° C. It should be appreciated that, when the first opening 115 is at the first diameter, the mixing chamber elements 112, 114 are unable to fit within the first opening 115. However, the mixing chamber components 112, 114 are manufactured and toleranced such that, after the first housing 102 is heated and the first diameter expands to the first expanded diameter, the mixing chamber elements 112, 114 are able to fit within the first opening 115. In one embodiment, the first expanded diameter is between 0.0001 and 0.0002 inches larger than the first diameter.

Third, the inlet mixing chamber element 112 is inserted into the first opening 115 of the heated first housing 102. The top surface 304 of the inlet mixing chamber element 112 is configured to be in contact with the bottom surface 132 of inlet retaining member 108. Because the inlet retaining member 108 is self-aligned with the chamfered mating surfaces of 119 and 130, the inlet mixing chamber element 112 is also properly aligned when surface 304 makes complete contact with surface 132 of inlet retaining member 108.

Fourth, the outlet mixing chamber element 114 is inserted into the first opening 115 of the heated first housing 102. The top surface 310 of the outlet mixing chamber element 114 is configured to be in contact with the bottom surface 306 of the inlet mixing chamber element 112. It should be appreciated that in some embodiments, the surface 306 and surface 310 include complimentary features that ensure the inlet mixing chamber element 112 is properly oriented and aligned with the outlet mixing chamber element 114. For example, in one embodiment, the inlet mixing chamber element 112 includes one or more protrusions that fit one or more complimentary recesses in the outlet mixing chamber element 114 so as to ensure proper rotational alignment of the two mixing chamber elements.

Fifth, once the mixing chamber elements 112, 114 are arranged within the first opening 115 of the heated first housing 102, the outlet retaining member 110 may be inserted into the first opening 115. The outlet retaining member 110 is substantially similar in structure to the inlet retaining member 108. Similar to the inlet retaining member 108, surface 132 of the outlet retaining member 110 is configured to make contact with surface 312 of the outlet mixing chamber element 114.

Sixth, the second housing 104 is aligned with the first housing 102 and the assembled first and second housings are operatively fastened together. As seen in FIG. 5, the second housing 104 includes protrusion 125 extending from top surface 126. When the first housing 102 is aligned with the second housing 104, protrusion 125 fits into the first opening 115. Similar to the opposite end of the first opening 115, the protrusion 125 includes a complimentary chamfered surface 123, which is configured to contact the chamfered surface 130 of the outlet retaining member 110. Also similar to the first housing's contact with the inlet retaining member 108, the chamfered surface 123 of protrusion 125 ensures that the outlet retaining member 110 is square to the inner surface 117 of opening 115. When both the inlet retaining member 108 and the outlet retaining member 110 are properly aligned by the first housing 102 and the protrusion 125 of the second housing 104 respectively, the inlet mixing chamber element 112 and the outlet mixing chamber element 114 are correctly aligned within the first opening 115. If the mixing chamber elements 112, 114 are even slightly misaligned, the elements may be damaged due to incorrect holding forces and the high pressure of the mixing. Additionally, the mixing results will be less consistent and reliable if the mixing chamber elements are not perfectly aligned by the retaining members and the first and second housings.

Seventh, the first housing may be operatively fastened to the second housing so that the inlet retainer, the inlet mixing chamber element, the outlet mixing chamber element, the outlet retainer, and the male member of the second housing are in compression. In the illustrated embodiment, six bolts 106 may be used to fasten the first housing 102 to the second housing 104. To ensure equal clamping force between the first housing 102 and the second housing 104, the bolts 106 are spaced sixty degrees apart and equidistant from central axis A. As discussed above, the fastening of six bolts 106 provides sufficient clamping force to seal surface 306 of the inlet mixing chamber element with surface 310 of the outlet mixing chamber element. It will be appreciated that any appropriate fastening arrangement or numbers of bolts may be used.

Eighth, the first housing is allowed to cool down from its heated state. In various embodiments, the first housing is cooled down by allowing it to return to room temperature or actively causing it to cool with an appropriate cooling agent. When the first housing is cooled, the material of the first housing contracts back, and the first housing expanded diameter is urged to contract back to the first housing diameter. Because the mixing chamber elements are already arranged and aligned inside of the first opening of the first housing, the contracting diameter of the first opening exerts a high amount of force directed radially inwardly on the mixing chamber elements. This force, in combination with the compressive force applied from the six bolts 106, is sufficient to hold the mixing chamber elements in place for the high pressure mixing. It should be appreciated that the mixing chamber elements can be made of any suitable material to withstand the radially inward stress of 30,000 pounds per square inch applied when the first opening diameter contracts. In one embodiment, the mixing chamber elements are constructed with 99.8% alumina. In another embodiment, the mixing chamber elements are constructed with polycrystalline diamond.

Referring now more specifically to FIGS. 7 and 8, a more detailed explanation of the mixing process of one example is discussed and illustrated. In FIG. 7, the inlet mixing chamber element 112 is illustrated. Top surface 304 is configured to contact the inlet retaining element 108 when inserted into the first opening 115 of the first housing 102. The inlet mixing chamber element 112 includes a plurality of ports 300, 302 extending from surface 304 toward bottom surface 306. Ports 300, 302 are small, and it should be appreciated that FIGS. 7 and 8 have been drawn out of scale for illustrative and explanatory purposes. On bottom surface 306 of the inlet mixing chamber element 112, a plurality of microchannels 308 are etched. The ports 300, 302 are in fluid communication with microchannels 308.

In FIG. 8, the outlet mixing chamber element 114 is illustrated. Outlet mixing chamber element 114 includes a plurality of microchannels 318 that are etched into top surface 310. Microchannels 318 on surface 310 of the outlet mixing chamber element 114 are configured to line up with microchannels 308 on surface 306 of the inlet mixing chamber element 112 of FIG. 7 when the two mixing chamber elements are aligned and sealingly abutted against one another. When in sealing contact with one another, the microchannels 308, 318 on each of the inlet mixing chamber element 112 and the outlet mixing chamber element 314 respectively create fluid-tight micro flow paths. The outlet mixing chamber element 114 also contains a plurality of outlet ports 314, 316, which are in fluid communication with microchannels 318, and the bottom surface 312 of outlet mixing chamber element 114.

In operation, when the inlet mixing chamber element 112 and the outlet mixing chamber element 114 are secured and held in the first housing between the inlet and outlet retaining members, surface 306 makes a fluid-tight seal with surface 310. The unmixed fluid is pumped through flow path 116 of the first housing 102, and through inlet retainer 108 to inlet mixing chamber element 112. At inlet mixing chamber element 112, the fluid is pumped at high pressure into ports 300 and 302, and then into the plurality of microchannels 308. Due to the decrease in fluid port size from flow path 116 to ports 300, 302 to microchannels 308, the pressure and shear forces on the unmixed fluid becomes very high by the time it reaches the microchannels 308. As discussed above, and because of the secure holding between the inlet and outlet mixing chamber elements, microchannels 308 and 318 combine to form micro flow paths, through which the unmixed fluid travels. When the micro flow paths converge on one another, the high pressure fluid experiences a powerful reaction, and the constituent parts of the fluid are mixed as a result. After the fluid has mixed in the micro flow paths, the mixed fluid travels through outlet ports 314, 316 of outlet mixing chamber element 114.

It will be understood that the compact interaction chamber assembly of the present disclosure succeeds in reducing the number and size of the components making the mixing assembly, resulting in cheaper manufacture and lower holdup volumes leading to less waste. In addition to saving cost and resources, the present disclosure performs consistently and reliably, and can advantageously be configured to operate with current machines needing no modification.

In one example embodiment of the present disclosure, the compact interaction chamber assembly includes a first housing with a first central axis, a second housing with a second central axis, a first mixing chamber element, a second mixing chamber element, and at least one retaining member.

The first housing has a first opening at a bottom face of the first housing, the first opening having a generally cylindrical shape with a first opening diameter and sharing the first central axis. The first housing also includes a first inlet protrusion extending from a top face of the first housing. The first inlet protrusion includes a first flow path that extends from the first opening through the first inlet protrusion and shares the first central axis.

The second housing includes a second outlet opening at a bottom face of the second housing, the second outlet opening sharing the second central axis. The second housing also includes a second protrusion of a second diameter extending from a top face of the second hosing. The second protrusion includes a second flow path that extends from the second outlet opening through the second protrusion and shares the second central axis. The second housing is configured to be fastened to the first housing so that the second central axis is collinear with the first central axis and the second protrusion is configured to extend into the first opening when the first and second housings are fastened to one another.

The first and second mixing chamber elements are configured to reside within the first opening of the first housing. As a result of the first and second housings being fastened to one another, a bottom face of the first mixing chamber element makes a fluid tight contact with a top face of the second mixing chamber element. After the first and second mixing chamber elements are arranged within the first opening, an outer edge of each of the first and second mixing chamber elements contacts the inner surface of the first opening such that the first and second mixing chamber elements are stressed radially inwardly to cause a fluid tight seal between the outer edge of each of the first and second mixing chamber elements and the inner surface of the first opening. The at least one retaining member is configured to reside within the first opening of the first housing and contacts the mixing chamber elements. When fully assembled, the hold-up volume of the compact interaction chamber is 0.05 ml, compared to the hold-up volumes of prior art devices that are on the order of about 0.5 ml.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

We claim:

1. A compact interaction chamber assembly comprising:

(a) a first housing with a first central axis, the first housing including:

(1) a first opening at a bottom face of the first housing, the first opening having a generally cylindrical shape of a first opening diameter and sharing the first central axis; and (2) a first protrusion extending from a top face of the first housing including a first flow path, the first flow path extending from the first opening through the first protrusion and sharing the first central axis;

(b) a second housing having a generally cylindrical shape with a second central axis, the second housing including:

(1) a second opening at a bottom face of the second housing, the second opening having a generally cylindrical shape and sharing the second central axis; and (2) a second protrusion of a second diameter extending from a top face of the second housing including a second flow path, the second flow path extending from the second opening through the second protrusion and sharing the second central axis, the second housing configured to be fastened to the first housing such that:

(A) the second central axis is collinear with the first central axis of the first housing; and (B) the second protrusion is configured to extend into the first opening when the first housing is fastened to the second housing;

(c) a first mixing chamber element and a second mixing chamber element, the first and second mixing chamber elements configured to reside within the first opening of the first housing, and be radially secured within the first opening by hoop stress of the first housing applied with thermal expansion and contraction without using a tube member that is stretched axially to hold the first and second mixing chamber elements radially, an outer surface of each of the first and second mixing chamber elements configured to make contact with an inner surface of the first opening of the first housing such that the first and second mixing chamber elements are compressed axially to cause a fluid tight seal between the outer surface of each of the first and second mixing chamber elements and an inner surface of the first opening of the first housing, wherein the axial compression is greater than or equal to 30,000 pounds per square inch, wherein, the first mixing chamber element is squeezed together with the second mixing chamber element so that a bottom face of the first mixing chamber element makes fluid tight contact with a top face of the second mixing chamber element; and (d) at least one retaining member configured to reside within the first opening of the first housing, and configured to retain the first and second mixing chamber elements.

2. The compact interaction chamber assembly of claim 1, wherein the first housing has a generally cylindrical shape.

3. The compact interaction chamber assembly of claim 1, wherein the second housing has a generally cylindrical shape.

4. The compact interaction chamber assembly of claim 1, wherein at least one of: (i) the first mixing chamber element includes a first plurality of microchannels etched into the bottom face; and (ii) the second mixing chamber element includes a second plurality of microchannels etched into the top face.

5. The compact interaction chamber assembly of claim 4, wherein the first plurality of microchannels are in fluid communication with a plurality of first ports extending from the bottom face of the first mixing chamber element to a top face of the first mixing chamber element.

6. The compact interaction chamber assembly of claim 4, wherein the second plurality of microchannels are in fluid communication with a plurality of second ports extending to a bottom face of the second mixing chamber element.

7. The compact interaction chamber assembly of claim 4, wherein the first mixing chamber element includes the first plurality of microchannels etched into the bottom face and the second mixing chamber element includes the second plurality of microchannels etched into the top face, and wherein when the first mixing chamber element is squeezed together with the second mixing chamber element, the first plurality of microchannels aligns with the second plurality of microchannels to create a plurality of micro fluid paths.

8. The compact interaction chamber assembly of claim 7, wherein the plurality of micro fluid paths are fluid tight.

9. The compact interaction chamber assembly of claim 1, wherein the first housing comprises stainless steel.

10. The compact interaction chamber assembly of claim 1, wherein the first mixing chamber element and the second mixing chamber element comprise 99.8% alumina.

11. The compact interaction chamber assembly of claim 1, wherein the first mixing chamber element and the second mixing chamber element comprise polycrystalline diamond.

12. The compact interaction chamber assembly of claim 1, wherein a volume of the compact interaction chamber assembly is equal to or less than 0.05 nil.

13. A compact interaction chamber assembly comprising:

(a) a first housing with a first central axis, the first housing including:

(1) a first opening at a bottom face of the first housing, the first opening having a generally cylindrical shape of a first opening diameter and sharing the first central axis; and (2) a first protrusion extending from a top face of the first housing including a first flow path, the first flow path extending from the first opening through the first protrusion and sharing the first central axis;

(b) a second housing having a generally cylindrical shape with a second central axis, the second housing including:

(1) a second opening at a bottom face of the second housing, the second opening having a generally cylindrical shape and sharing the second central axis; and (2) a second protrusion of a second diameter extending from a top face of the second housing including a second flow path, the second flow path extending from the second opening through the second protrusion and sharing the second central axis, the second housing configured to be fastened to the first housing such that:

(A) the second central axis is collinear with the first central axis of the first housing; and (B) the second protrusion is configured to extend into the first opening when the first housing is fastened to the second housing; and (c) a first mixing chamber element and a second mixing chamber element, the first and second mixing chamber elements configured to reside within the first opening of the first housing, and be radially secured within the first opening by hoop stress of the first housing applied with thermal expansion and contraction without using a tube member that is stretched axially to hold the first and second mixing chamber elements radially, an outer surface of each of the first and second mixing chamber elements configured to make contact with an inner surface of the first opening of the first housing such that the first and second mixing chamber elements are compressed axially to cause a fluid tight seal between the outer surface of each of the first and second mixing chamber elements and an inner surface of the first opening of the first housing, wherein the axial compression is greater than or equal to 30,000 pounds per square inch, wherein, the first mixing chamber element is squeezed together with the second mixing chamber element so that a bottom face of the first mixing chamber element makes fluid tight contact with a top face of the second mixing chamber element.

14. The compact interaction chamber assembly of claim 13, wherein at least one of the first housing and the second housing has a generally cylindrical shape.

15. The compact interaction chamber assembly of claim 13, wherein at least one of: (i) the first mixing chamber element includes a first plurality of microchannels etched into the bottom face; and (ii) the second mixing chamber element includes a second plurality of microchannels etched into the top face.

16. The compact interaction chamber assembly of claim 13, wherein the first plurality of microchannels are in fluid communication with a plurality of first ports extending from the bottom face of the first mixing chamber element to a top face of the first mixing chamber element.

17. The compact interaction chamber assembly of claim 15, wherein the second plurality of microchannels are in fluid communication with a plurality of second ports extending to a bottom face of the second mixing chamber element.

18. The compact interaction chamber assembly of claim 15, wherein the first mixing chamber element includes the first plurality of microchannels etched into the bottom face and the second mixing chamber element includes the second plurality of microchannels etched into the top face, and wherein when the first mixing chamber element is squeezed together with the second mixing chamber element, the first plurality of microchannels aligns with the second plurality of microchannels to create a plurality of micro fluid paths.

19. The compact interaction chamber assembly of claim 13, wherein the first mixing chamber element and the second mixing chamber element comprise 99.8% alumina.

20. The compact interaction chamber assembly of claim 13, wherein the first mixing chamber element and the second mixing chamber element comprise polycrystalline diamond.

21. The compact interaction chamber assembly of claim 13, wherein a volume of the compact interaction chamber assembly is equal to or less than 0.05 nil.

* * * * *